US007201237B2

(12) United States Patent
Raney

(10) Patent No.: US 7,201,237 B2
(45) Date of Patent: Apr. 10, 2007

(54) STABILIZING SYSTEM AND METHODS FOR A DRILL BIT

(76) Inventor: Richard C. Raney, 2804 Phoenix Way, Round Rock, TX (US) 78664

( * ) Notice: Subject to any disclaimer, the term of this patent is extended or adjusted under 35 U.S.C. 154(b) by 0 days.

(21) Appl. No.: 11/164,755

(22) Filed: Dec. 5, 2005

(65) Prior Publication Data

US 2006/0196697 A1 Sep. 7, 2006

Related U.S. Application Data

(62) Division of application No. 10/135,201, filed on Apr. 30, 2002, now Pat. No. 6,971,459.

(51) Int. Cl.
*E21B 10/54* (2006.01)

(52) U.S. Cl. ..... 175/57; 175/307; 175/406; 175/425

(58) Field of Classification Search ..... 175/57, 175/425, 307, 406, 408
See application file for complete search history.

(56) References Cited

U.S. PATENT DOCUMENTS

| | | | | |
|---|---|---|---|---|
| 712,887 | A | | 11/1902 | Wyczynski |
| 1,738,860 | A | | 12/1929 | Wigle |
| 1,886,789 | A | | 11/1932 | Carlson |
| 2,857,141 | A | | 10/1958 | Carpenter |
| 3,051,255 | A | | 8/1962 | Deely |
| 3,062,303 | A | | 11/1962 | Schultz |
| 3,120,285 | A | | 2/1964 | Rowley et al. |
| 3,123,162 | A | | 3/1964 | Rowley |
| 3,123,163 | A | | 3/1964 | Overby |
| 3,180,436 | A | | 4/1965 | Kellner et al. |
| 3,225,843 | A | | 12/1965 | Ortloff et al. |
| 3,512,592 | A | | 5/1970 | Kellner |
| 3,871,488 | A | * | 3/1975 | Sabre ..... 175/406 |
| 4,022,287 | A | | 5/1977 | Lundstrom et al. |
| 4,071,097 | A | | 1/1978 | Fulop et al. |
| 4,190,123 | A | | 2/1980 | Roddy |
| 4,244,521 | A | | 1/1981 | Guse |
| 4,253,533 | A | | 3/1981 | Baker, III |
| 4,270,619 | A | | 6/1981 | Base |
| 4,306,627 | A | | 12/1981 | Cheung et al. |
| 4,351,402 | A | | 9/1982 | Gonzalez |
| 4,388,974 | A | | 6/1983 | Jones, Jr. et al. |
| 4,397,361 | A | * | 8/1983 | Langford, Jr. ..... 175/428 |
| 4,397,363 | A | | 8/1983 | Fuller |
| 4,499,958 | A | | 2/1985 | Radtke et al. |

(Continued)

*Primary Examiner*—Hoang Dang
(74) *Attorney, Agent, or Firm*—Hahn Loeser & Parks, LLP; Robert J. Clark

(57) ABSTRACT

A drill bit stabilizing system comprising a body member having an axis and at least one recess formed in the body member housing at least one stabilizing member when in a first retracted position. The stabilizing member is positionable along a diagonal angle with the axis to a second extended operating position which extends downward and outward relative to the main body to selectively engage the surface of a pilot bore hole wall during a drilling operation so as to stabilize an under gauge drill bit used in association with the stabilizing system. The body member further comprises at least one fixed stabilizing surface positioned in an axially spaced relationship to the at least one moveable stabilizing member. The body member further comprises a gauge cutter positioned above the moveable stabilizing member and below the fixed stabilizing surface to expand the pilot hole to the final gauge.

14 Claims, 8 Drawing Sheets

U.S. PATENT DOCUMENTS

| | | | | |
|---|---|---|---|---|
| 4,505,342 | A | | 3/1985 | Barr et al. |
| 4,577,706 | A | | 3/1986 | Barr |
| 4,596,296 | A | | 6/1986 | Matthias |
| 4,603,750 | A | | 8/1986 | Sorenson |
| 4,681,160 | A | | 7/1987 | Fineberg |
| 4,690,229 | A | | 9/1987 | Raney |
| 4,693,328 | A | | 9/1987 | Furse et al. |
| 4,703,814 | A | | 11/1987 | Nguyen |
| 4,842,083 | A | | 6/1989 | Raney |
| 4,856,601 | A | | 8/1989 | Raney |
| 5,090,492 | A | * | 2/1992 | Keith ..... 175/408 |
| 5,368,114 | A | | 11/1994 | Tandberg et al. |
| 5,560,439 | A | | 10/1996 | Delwiche et al. |
| 5,595,252 | A | * | 1/1997 | O'Hanlon ..... 175/57 |
| 5,788,000 | A | | 8/1998 | Maury et al. |
| 6,138,780 | A | | 10/2000 | Beuershausen |
| 6,227,312 | B1 | | 5/2001 | Eppink et al. |
| 6,971,459 | B2 | | 12/2005 | Raney |
| 2004/0069531 | A1 | * | 4/2004 | McCormick et al. ..... 175/57 |

* cited by examiner

STABILIZING SYSTEM AND METHODS FOR A DRILL BIT

This application is a divisional of U.S. patent application Ser. No. 10/135,201, filed Apr. 30, 2002 now U.S. Pat. No. 6,971,459, hereby incorporated by reference.

TECHNICAL FIELD

This invention relates generally to drill bit and drill bit stabilizing systems and methods for use in borehole forming operations wherein a drill bit is connected to a drill string and rotated while drilling fluid flows down the drill string to the drill bit for circulating cuttings up the borehole as the hole is drilled. More particularly, the invention relates to stabilizing systems and methods for stabilization of a drill bit so as to minimize vibration and possible damage to the drill bit or other structures.

BACKGROUND OF THE INVENTION

My prior U.S. Pat. Nos. 4,842,083; 4,856,601; and 4,690,229, which are hereby incorporated by reference, are directed to drilling systems and methods providing distinct advantages. U.S. Pat. No. 4,842,083, entitled "Drill Bit Stabilizer", is directed to a stabilizing system to stabilize the drill bit and drilling string in a down hole system, and the present invention is directed to improvements in the system and methods described therein. Although the prior system and methods provide the desired stabilization of the drill bit under most circumstances, it has been found to be desirable to minimize the actuating forces required on the wedge shaped stabilizing members in order to affect the frictional blocking action needed for radial stability. Also, it has been found to be desirable to account for high down hole drilling pressures, particularly where the stabilizing members are spring actuated, such that the drilling fluid pressure does not adversely interfere with the spring action of the stabilizing members. Blockages of various orifices or recesses in the system can also cause problems, and the present invention is directed at reducing or eliminating such possible blockages, particularly around the stabilizing members. It has also been found that under certain conditions, the bit may not be properly stabilized by the stabilizing members, such as at the beginning of a drilling operation or where no pilot hole is formed in the borehole. In such situations, it would be desirable to provide stabilization for the bit face until sufficient hole has been drilled to allow the stabilizing members to engage the bore hole wall. Thus, it would be desirable to prevent vibration damage of PDC cutting elements on the bit which can occur during the start of drilling a bore hole, or to prevent harmful axis wobble of the assembly may occur during ongoing drilling operation.

As will be shown herein, the present invention includes improved means so as to overcome the deficiencies and problems mentioned above.

SUMMARY OF THE INVENTION

It is therefore an object of the present invention to provide a drill bit stabilizing system and methods which overcome the above noted problems.

The structure of the present invention may be generally similar to that shown in prior U.S. Pat. No. 4,842,083; except that the various improvements have been provided, both as to the methods and stabilizing system of the invention. In one aspect, the invention is directed to a drill bit stabilizing system comprising a body member having an axis, and at least one recess formed in the body member for housing at least one stabilizing member when in a first retracted position. The at least one stabilizing member is biased to a second extended operating position. The body member further comprises at least one fixed stabilizing surface positioned in axially spaced relationship to the at least one moveable stabilizing member. In another aspect, the invention is directed to a drill bit stabilizing system comprising a body member and at least one stabilizing member, being moveable from an extended operating position to a retracted position within the body member. The at least one stabilizing member comprises outer contact faces adapted to engage the wall of a bore hole when in an operating position, and an inner slide surface adapted to slidingly engage a corresponding slide surface formed in the body member. The inner slide surface comprises at least one relief groove to facilitate the reduction of the surface area of the surface and thereby provide a predetermined increase in the contact pressure per square inch between the inner slide surface and corresponding slide surface associated with the body member. In a further aspect, the slideable, wedge shaped stabilizing members are entirely spring actuated and the at least one stabilizing member comprises a plunger portion provided in a spring chamber formed in the body member. The spring chamber comprises an amount of incompressible fluid therein, and a fluid displacement system in fluid communication with the spring chamber to provide pressure equalization upon movement of the plunger within the spring chamber. The invention is also directed to a drill bit for forming a bore hole wherein the drill bit is attached to a rotary drill string having an axial passageway through which drilling fluid flows to the bit face. The bit comprises a plurality of wear ridges and a plurality of cutters in association with the bit face, the plurality of wear ridges characterized in providing an initial support surface for the weight applied to the bit during a drilling operation. There is also provided a method of drilling a bore hole using a drill bit rotated in conjunction with a drill string. The method comprises the steps of providing a drill bit having a plurality of wear ridges on the bit face along with a plurality of cutting elements. The plurality of wear ridges initially extend outwardly from the bit face to a greater extent than the plurality of cutting elements. The drill bit is rotated along with the drill string to initiate a drilling operation or in an existing full gauge hole to form a pilot hole. Upon rotation of the drill bit, the plurality of wear ridges will allow rotation of the drill bit and drill string for a period of time before engagement of the plurality of cutting elements.

Other objects and advantages of the present invention will be apparent upon consideration of the following specification, with reference to the accompanying drawings in which like numerals correspond to like parts shown in the drawings.

DETAILED DESCRIPTION

Referring to the figures of the drawings, the embodiment comprises an improved stabilizer and drill bit, generally indicated by the numeral 100. The invention in one aspect is generally directed to a drill bit stabilizer having a main body of generally cylindrical configuration and a pin end opposed to a lower drilling end. The system is attachable to or includes a drill bit for making a borehole when rotation occurs. A throat is formed longitudinally through the main body of the stabilizer for passage of drilling fluid from a drill string, through the body, and through nozzles of the bit. The drilling fluid exits the bit and returns up the borehole annulus. A plurality of circumferentially arranged wedge shaped pockets or recesses are formed about the main body from the outer surface of the main body inward to slideably receive corresponding wedge shaped stabilizing members. Means are provided by which the stabilizing members are spring actuated. The stabilizing members are each therefore reciprocatingly received in a slideable manner, as they are spring actuated within each respective pocket. Each of the stabilizing members has an outer face which can be retracted into alignment with the outer surface of the main body, and which can be extended outwardly from the surface of the main body and into abutment with the wall of a borehole. Flushing orifices are provided to allow a limited volume of drilling fluid to flow from the throat through the pockets so as to prevent jamming of the stabilizing members by detritus material.

The before mentioned spring means are incorporated into the main body in a manner such that each of the stabilizing members is forced to move in an angular direction downwardly and outwardly of the main body. The spring means forces the stabilizing members towards the extended configuration and, as the face of the stabilizing member, or the borehole wall, is worn, the face of the member is further extended to maintain abutment with the borehole wall. Frictional means is provided to lock, or block, the stabilizing members in any one of a range of extended positions. The frictional means is the friction between the sliding surfaces of the wedge shaped stabilizing members and the corresponding surfaces of the pockets within which the wedges are received.

Figure 1:
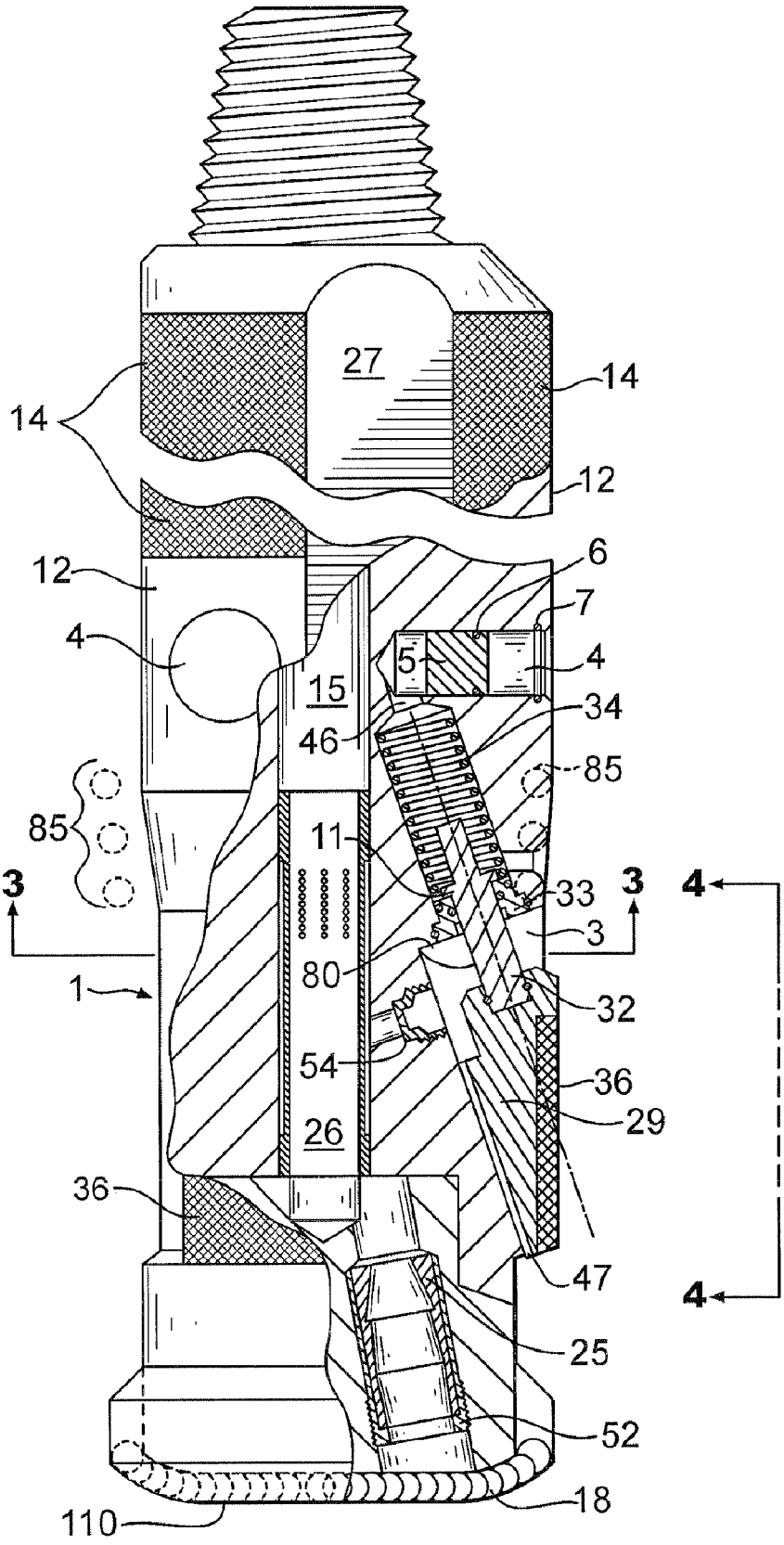
FIG. 1 is a longitudinal, partially sectioned view of the preferred embodiment.

More particularly, and with respect to the embodiments shown in the drawings, the stabilizer comprises a main body 1 made of a suitable material such as steel. The main body 1 is generally cylindrical in shape and the upper end thereof is threaded in the conventional manner or is otherwise provide with a known means for attachment to the end of a drill pipe or "drill string". The main body 1 has a central fluid passage or throat 15 extending from the top end, axially along the central axis towards the lower end. The lower marginal end of the main body 1 may be an integral part of a drill bit 110, as shown in FIG. 1, or it may be a separate member suitably attachable to a drill bit with the throat 15 arranged to provide a flow of fluid therethrough to the drill bit, as described in my previous U.S. Pat. No. 4,842,083, of which this invention is a continuation in part.

Figure 3:
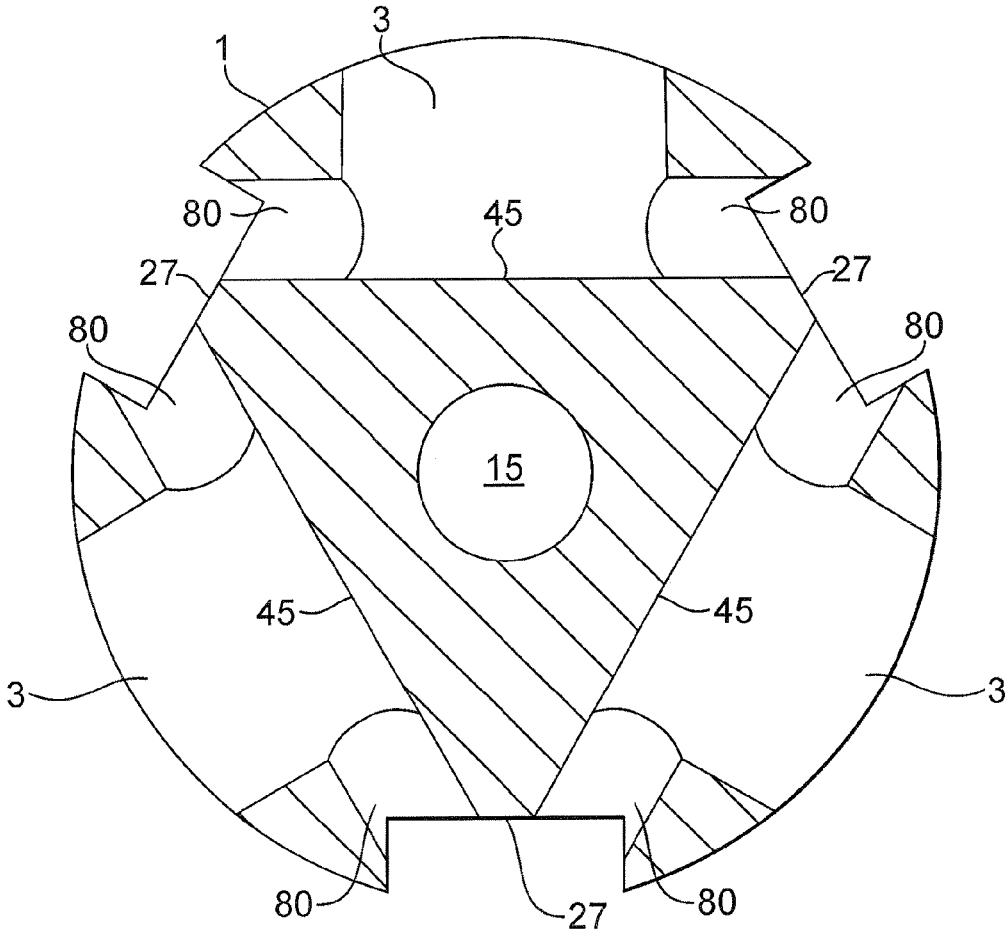
FIG. 3 is a cross sectional view taken along line 3—3 of FIG. 1.
Figure 6:
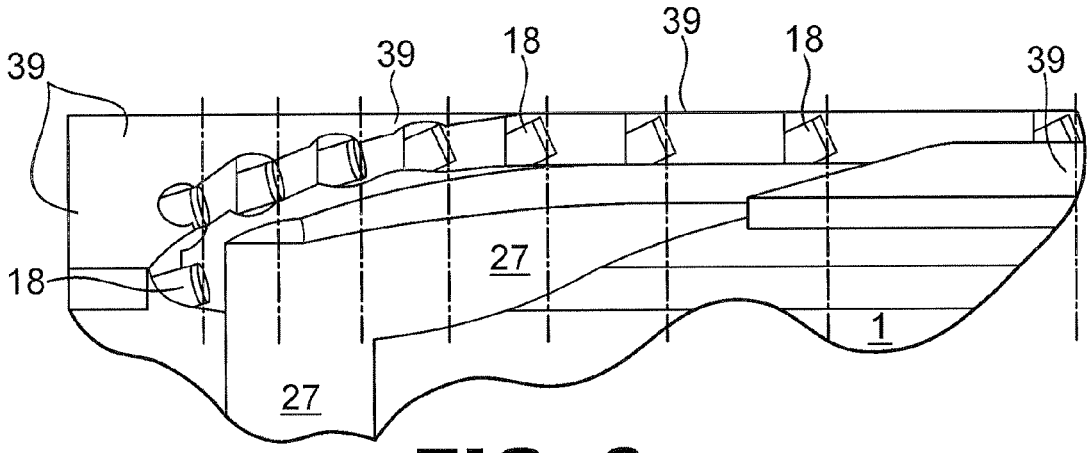
FIG. 6 is a flattened partial side view taken along line 6—6 of FIG. 2.
Figure 4:
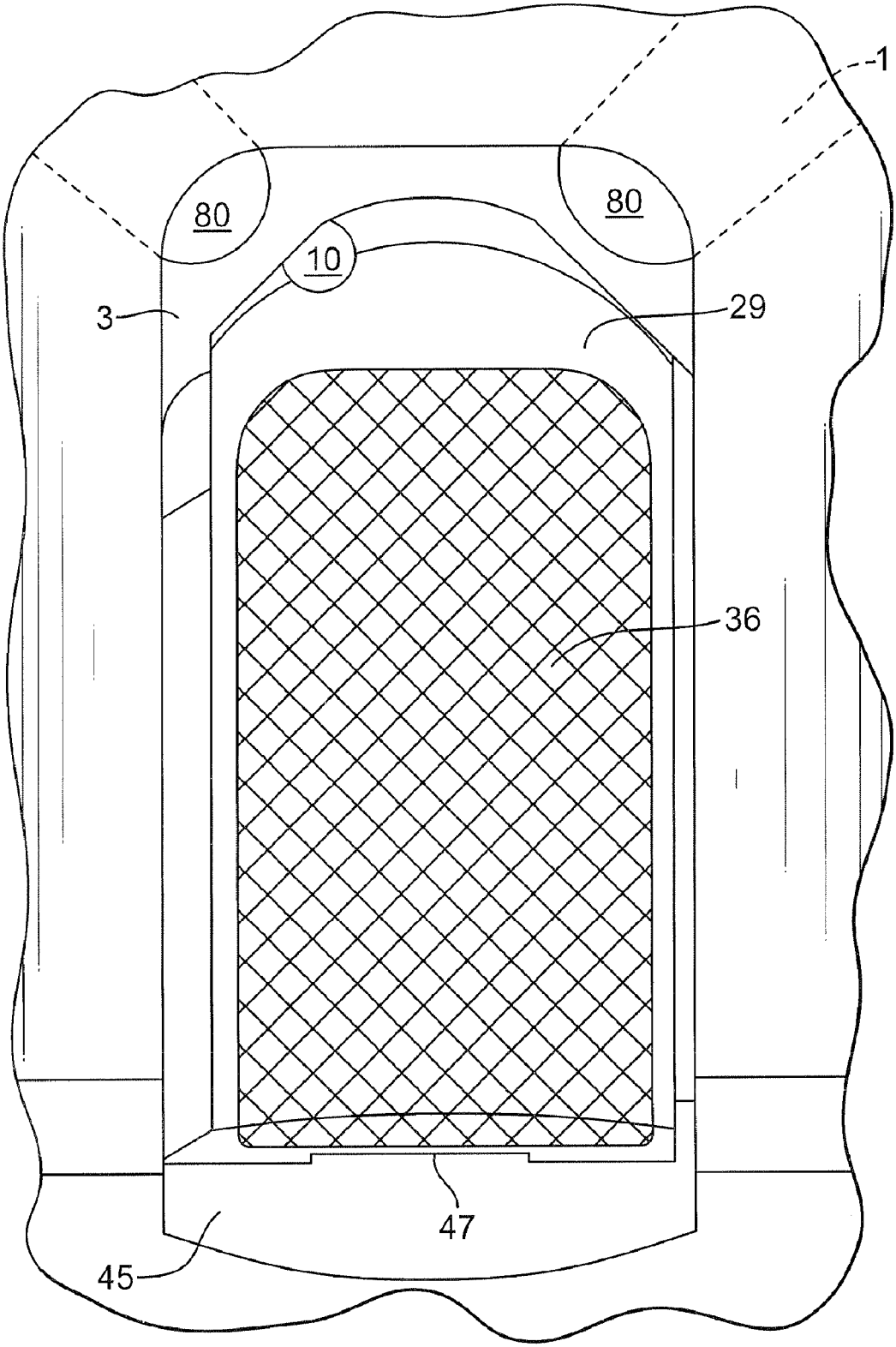
FIG. 4 is an enlarged partial side view taken along line 4—4 of FIG. 1.

The embodiment 100 includes a plurality of moveable and radial stabilizing wedges 29 installed in complementary radial pockets 3 formed into the main body 1 in spaced relationship respective to the throat 15. The pockets 3, with the respective wedges 29 installed therein, are symmetrically arranged circumferentially about the central longitudinal axis of the main body 1, as shown in FIGS. 1 and 3. The embodiment 100 of FIGS. 1 and 3 includes three such pockets 3 and three corresponding wedges 29; however, any suitable number may be employed.

Figure 15:
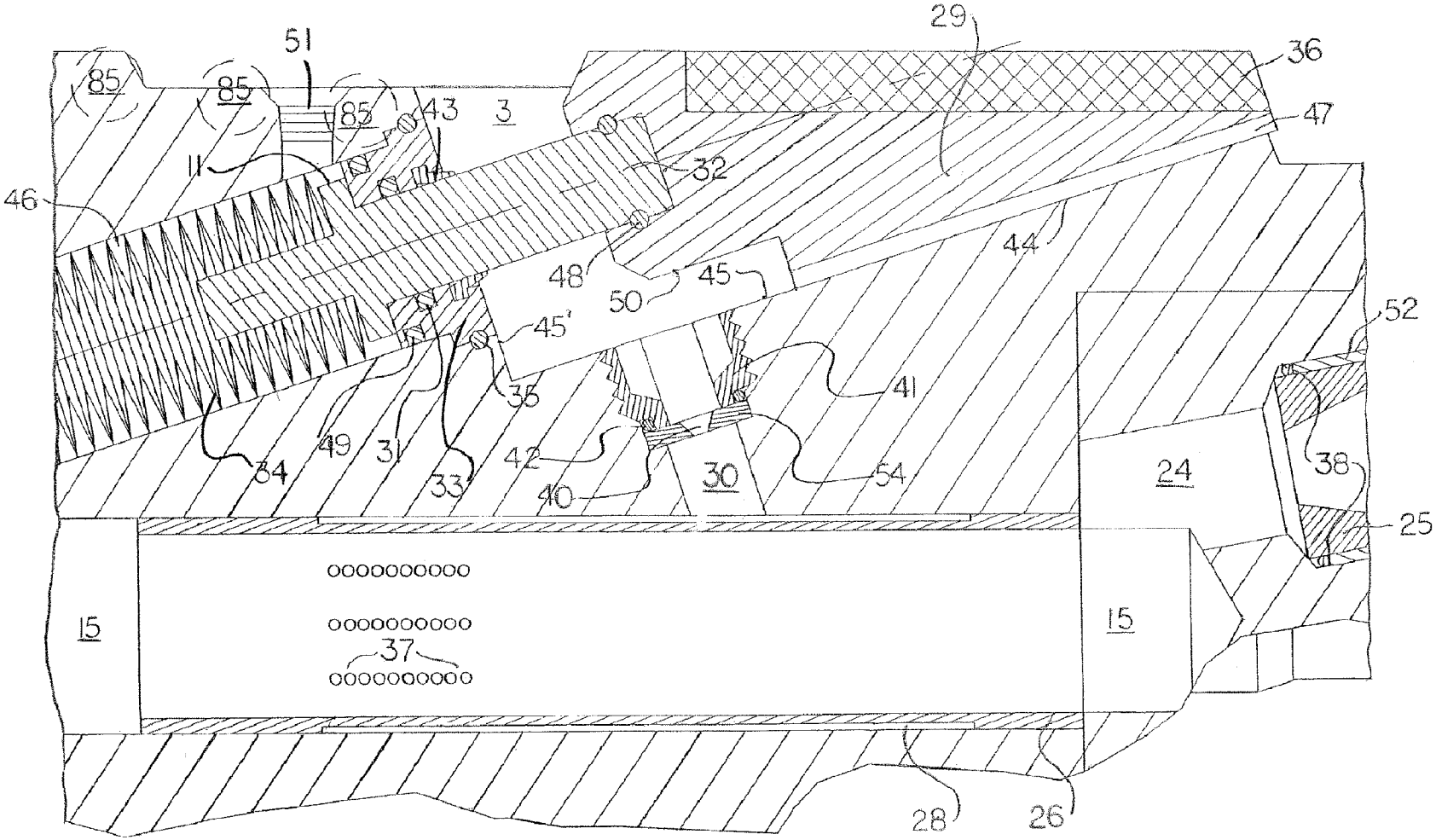
FIG. 15 is an enlarged partial sectional view of FIG. 1.

The pockets 3 are each shaped and arranged to provide a mated slide surface 45 which is inclined downward and outward relative to the central axis of the main body 1. The upper end surface 45' of each pocket 3 is generally perpendicular to the inclined slide surface 45, as seen in FIG. 15. Each wedge 29 is correspondingly shaped and arranged so that the outer surface of each wedge 29 is flush or aligned with the outer surface of the main body 1 when the wedges 29 are fully seated into the pockets 3. Each wedge has an inner slide surface 44 which is mated to and arranged to slide against the slide surface 45.

The outer faces of the wedges 29 are provided with suitably thick wear resistant tungsten carbide surfaces 36 formed onto the outer faces of the wedges 29 so that the wear resistant surfaces 36 are flush or aligned with the outer faces of the wedges 29, thereby making the outer faces of the wedges 29 wear resistant. The wedges 29 may alternatively be made entirely of a wear resistant material, such as ceramic, or may be made wear resistant by other known expedients, such as applying PDC diamond to the faces.

Figure 5:
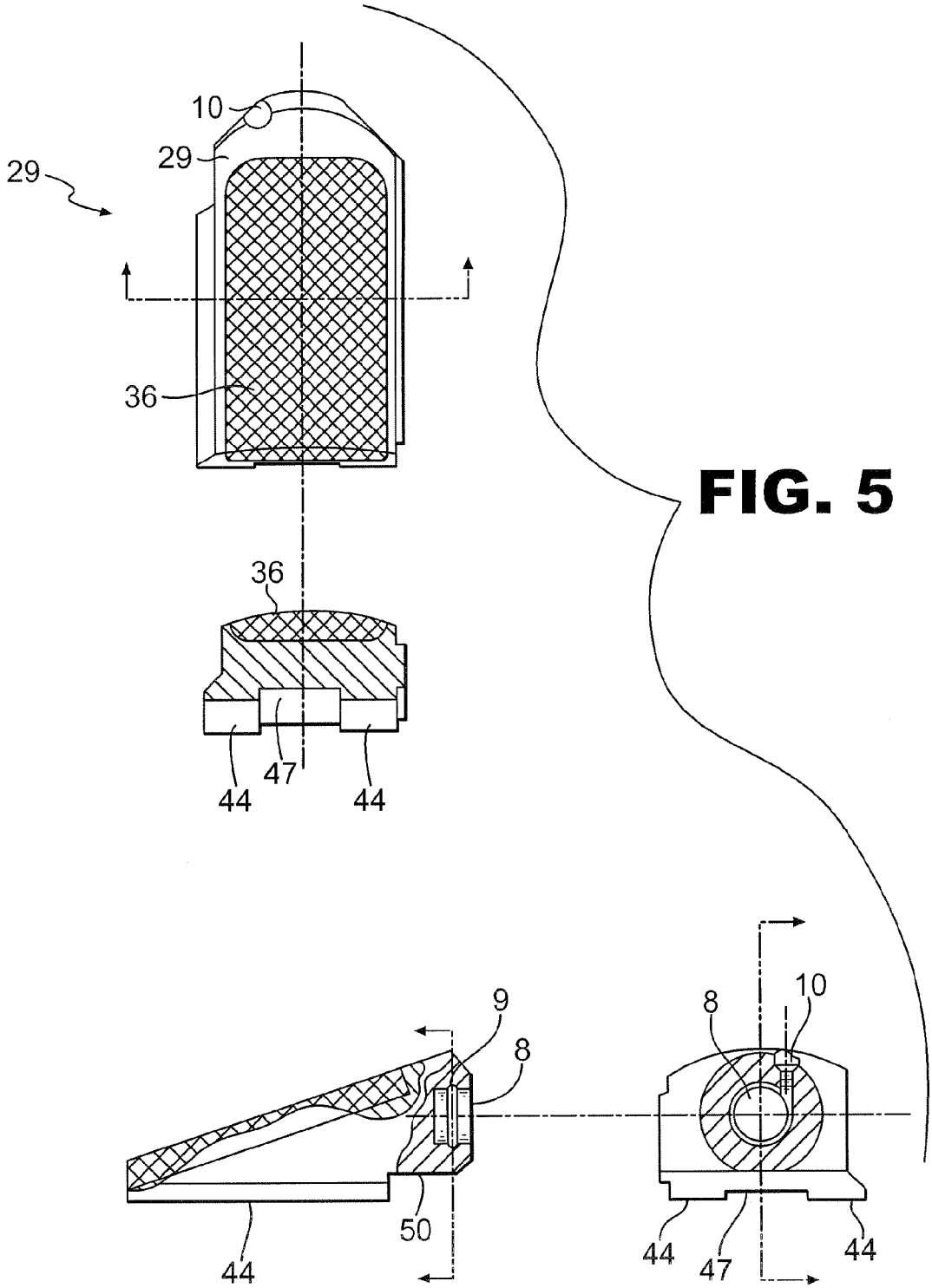
FIG. 5 is a multi-view illustration of the item shown in FIG. 4.
Figure 7:
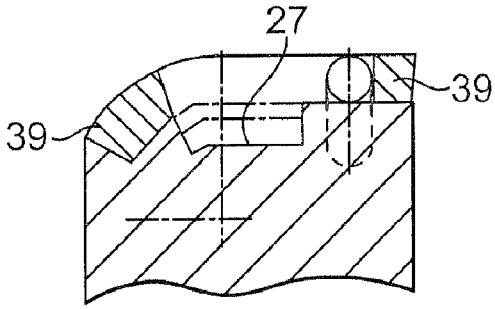
FIGS. 7 through 14 are partial sectional views of various portions of items shown in FIG. 2.
Figure 11:
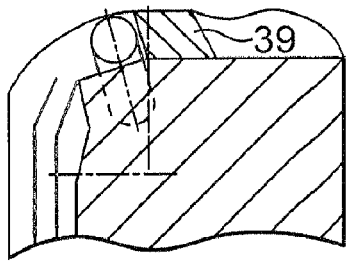
Figure 8:
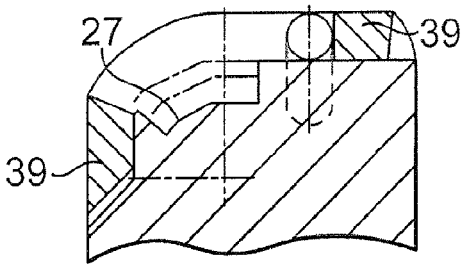
Figure 12:
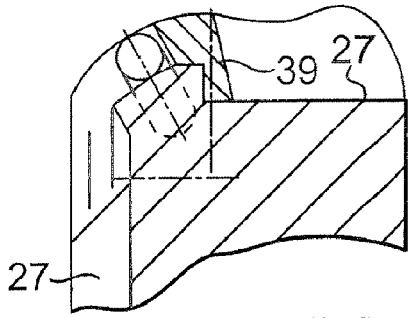
Figure 9:
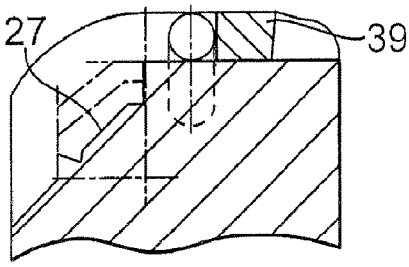
Figure 13:
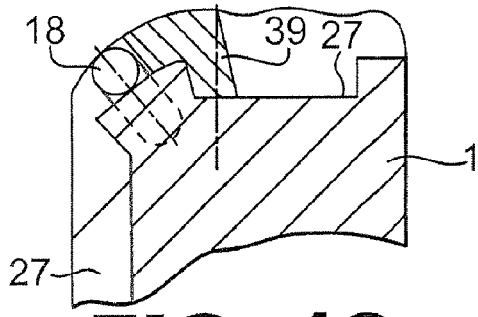
Figure 10:
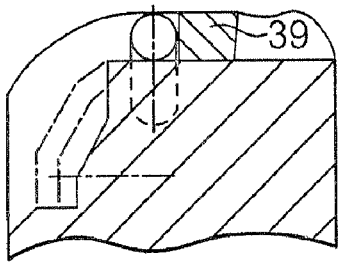
Figure 14:
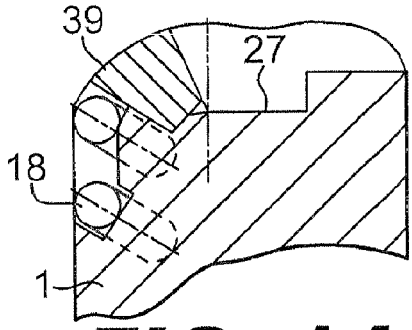

Corresponding plungers 32 are attached to the upper end of each wedge 29 and extend upward and inward parallel to the slide surface 45 of each pocket 3. To facilitate proper operation, the coupling between the wedge 29 and corresponding plungers 32 is preferably non-rigid or has some flexibility to allow some movement between these members. Such a connection will avoid the formation of a high stress point at this location. In the embodiment shown, to attach the wedges 29 to the plungers 32, a bore 8 is formed in the large end of each wedge, as shown in FIG. 5; with an annular groove 9 formed therein. As shown in FIG. 15, the lower ends of plungers 32 are formed to correspond to bores 8 and have grooves formed thereon to match with grooves 9. As shown in FIG. 5, an access hole 10 is drilled tangent to groove 9 in each wedge 29 to allow insertion of metal balls 48, of metal such as stainless steel, so the matching grooves are filled with metal balls to thereby attach the wedges 29 to the plungers 32, as seen in FIG. 15. The access holes 10 are tapped to receive plugs to retain the metal balls in place.

Complementary bores 46', which do not communicate with the throat 15, are provided to receive each plunger 32. Each bore 46' has an enlarged section to form a spring chamber 46 and to accommodate seal bushing 33. The seal bushings 33 are installed in fixed relationship within the lower marginal end of spring chambers 46 and reciprocatingly receive the plungers 32 in sealed relationship therewith by means of the illustrated o-rings 31. Wipers 43 are also added to prevent debris from harming the o-rings 31 during reciprocating movements of the plungers 32. The seal bushings 33 are sealed to the spring chambers 46 by o-rings 49 and are affixed therein by locking rings 35, or by other suitable known means. Springs 34, such as Belleville washers, and preferably of the stacked disk type, are received about each plunger 32 between the seal bushing 33 and the upper end of spring chambers 46. The springs 34 are thus respectively confined and sealed within the chambers 46 at a location between the upper end of chamber 46 and seal bushing 33. To prevent harmful effects from high static pressures encountered down hole during operation, the spring chambers 46 must be filled with an incompressible fluid, such as hydraulic oil, which is sealed therein by plugs 51; and all air or gas bubbles should be removed.

In addition, since any reciprocating movement of plungers 32 will produce a displacement of fluid in chambers 46, complementary bores 46' extend upward to intersect and provide fluid communication with corresponding radial bores 4, as shown in FIG. 1. A moveable sealing member 5, such as a free traveling piston is installed in each bore 4 and moveably sealed therein by an o-ring 6 so as to keep fluid within chamber 46, bore 46' and the inner portion of bore 4. The moveable sealing member 5 could be of a different character, such as a sealed diaphragm or the like, while accommodating fluid displacement. Thus, as plunger 32 moves in or out during operation, corresponding moveable sealing member 5, such as a piston, freely moves in or out to accommodate the change in fluid volume within chamber 46. A retaining ring 7 is installed in bore 4 to keep piston 5 from inadvertently traveling too far outward in bore 4. Thus, the in or out travel of plunger 32 and wedge 29 is not hindered nor affected by static down hole pressure nor by fluid pressure within throat 15.

A suitable flange 11 is formed on each plunger 32 to provide contact with springs 34; and to abut against the seal bushings 33 so as to limit the outward travel of each plunger 32 at the appropriate distance. The springs 34 are arranged to press against the flanges 11 and thereby bias the plungers 32, and the wedges 29 attached thereto, outward. As will be explained later herein, the wedges 29 and plungers 32 are to be retracted inward by other force means, such as by thrust of the wedges 29 against the rim of the pilot hole formed by the bit 110.

As seen in FIGS. 1 and 15, flushing orifices 54 are positioned to provide fluid communication between throat 15 and each pocket 3 and are sized and arranged to provide an effectual flow of fluid through each pocket 3 so as to prevent detritus material from packing or jamming around the wedges 29. As shown in FIGS. 1 and 15 of embodiment 100, orifice 54 may be in the form of a disk made of abrasion resistant material, such as tungsten carbide, having an aperture 40 approximately 0.100 inch to 0.125 inch in diameter. As shown in FIG. 15, aperture 40 is preferably tapered and flared outward downstream so as to minimize the velocity of fluid exiting therethrough. Orifice 54 is retained in a suitably formed port 30 by means of a hollow screw 41 and sealed therein by an o-ring 42. Each port 30 intersects throat 15 and provides fluid communication therethrough between throat 15 and each corresponding orifice 54. Thus, flushing fluid, such as drilling fluid passing under pressure within throat 15, can pass outward through each orifice 54, outward through each pocket 3 and around each wedge 29 so as to remove detritus material or debris which might otherwise pack around the wedges 29 and jam proper movement thereof.

In order to prevent orifices 54 from becoming clogged by foreign material which might be present in drilling fluid passing through throat 15, a strainer sleeve 26 is installed in throat 15 adjacent ports 30, as shown in FIGS. 1 and 15. The outer surfaces of strainer sleeve 26 are formed so that the upper and lower end portions fit closely within throat 15, but the intermediate portion is smaller in diameter so that a small but adequate annular space 28 is provide between the sleeve 26 and the wall of throat 15 adjacent to the ports 30. The inner surface of sleeve 26 is cylindrical. A plurality, preferably up to 200, strainer holes 37 are drilled in sleeve 26 within the region of annular space 28, but sufficiently above the vicinity of ports 30, as shown in FIG. 15. The holes 37 are positioned above and away from ports 30 so as to prevent erosion of the holes 37 due to the swirl of fluid entering ports 30. Thus, drilling fluid is permitted to pass from throat 15 through holes 37, through annular space 28, through ports 30 and through orifices 54 into pockets 3. The strainer holes 37 are approximately 0.050 inch to 0.070 inch in diameter so as to be smaller than the apertures 40. Thus, foreign material large enough to clog orifices 54 cannot pass through strainer sleeve 26 when passing through throat 15. The annular space 28 is, preferably, made no wider than 0.070 inch so that it too prevents clogging of orifices 54. Notice that the apertures 40 are sized to provide a flow rate through each of approximately 10 gpm to 15 gpm at the usual operating pressures.

In tests, it has been found that flushing fluid exiting orifices 54 and passing through pockets 3 can cause erosion damage to the sealing surface of plungers 32. To prevent such erosion damage, a clearance notch 50 is formed on the inner, upper end of each wedge 29, as shown in FIGS. 5 and 15; and ports 30 and orifices 54 are positioned so that fluid exiting orifices 54 impinges against notches 50 so as to deflect the fluid in a manner that does not erode the surface of plungers 32.

In normal operation, the main flow of drilling fluid through throat 15 is to the nozzles of the bit 110, so that foreign material or debris cannot clog the strainer holes 37 because the main flow through throat 15 will wash them away towards the nozzles of the bit 110. To further enhance this washing action, throat 15, in the vicinity of sleeve 26, along with sleeve 26, is made small enough in diameter so that a relatively high fluid velocity is achieved therethrough during normal operation. For example, when around 300 gpm of drilling fluid is provided, 1-¼ to 1-½ inch inside diameter of sleeve 26 seems to produce sufficient fluid velocity for effective washing action. To prevent undue erosion of sleeve 26, preferably, sleeve 26 should be made of case hardened steel, or some harder material.

Figure 2:
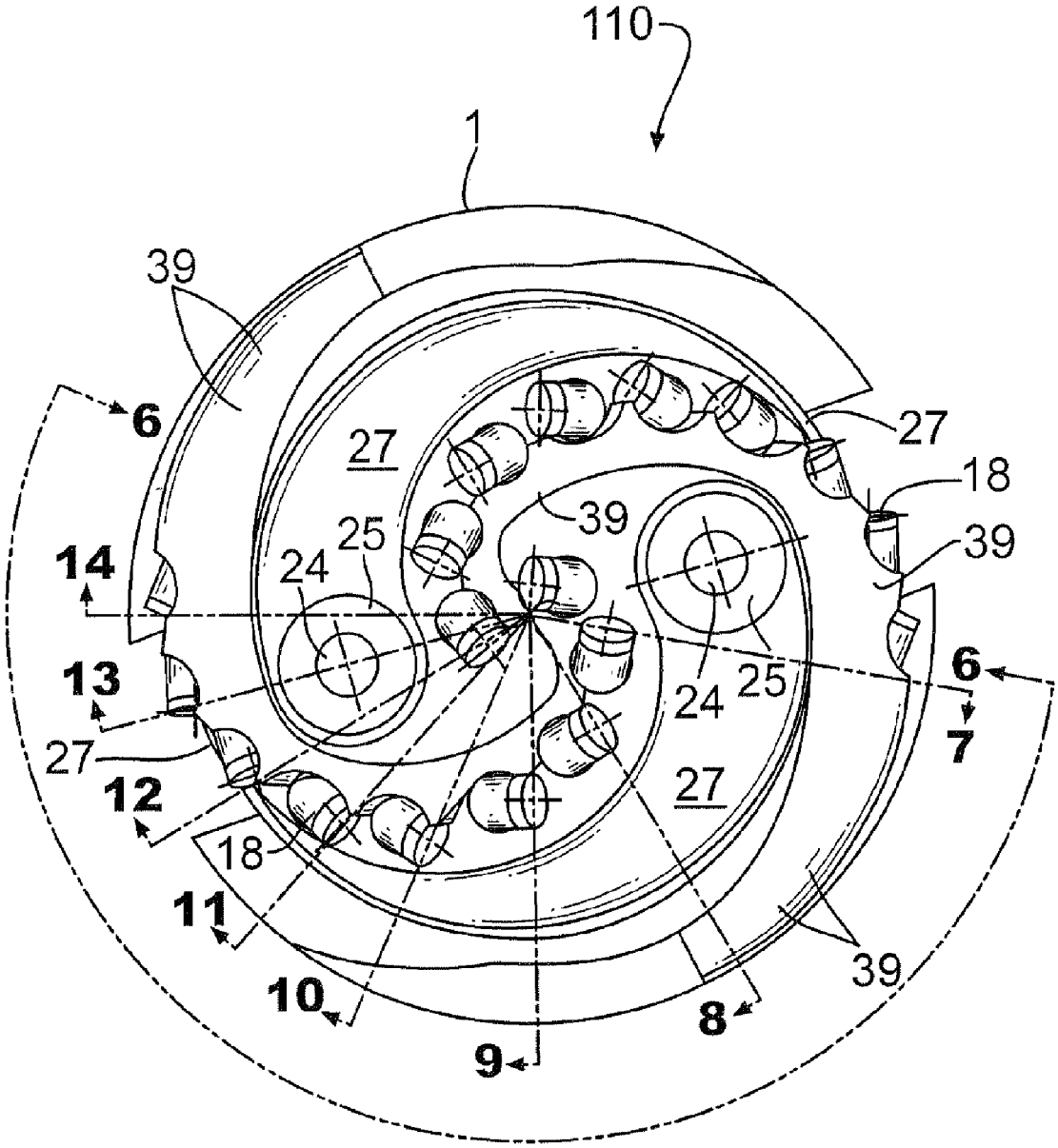
FIG. 2 is a straight-on bottom view of the embodiment.

As shown in FIGS. 1, 2, and 15, the bit 110 is equipped with a plurality of nozzles 25, similar to the arrangement described in my prior U.S. Pat. No. 4,856,601, which are arranged to provide optimum fluid flow restriction and appropriate fluid output velocity. The nozzles 25 are installed in corresponding nozzle ports 24 which are formed and arranged to communicate with throat 15. The nozzles 25 are retained in ports 24 by means of threaded retainers 52 and sealed against leak-by by means of o-rings 38. Nozzles 25 will usually be made of abrasion resistant material such as tungsten carbide.

As shown in FIGS. 1, 2 and 3, a plurality of flow slots 27 are formed in the face of bit 110 and along the outside of main body 1 to permit the return flow of drilling fluid exiting nozzles 25 during operation and to thereby evacuate drilled cuttings from the bore hole. Also, a plurality of cutting elements 18, usually the PDC type, are installed, positioned and arranged on bit 110 so as to cut rock from the bottom of the borehole as bit 110 is rotated during operation.

As seen in FIG. 1, the portion of the main body 1 immediately above the wedges 29 is slightly larger in diameter than the bore hole produced by the drill bit 110 and has installed therein a plurality of secondary gauge cutting elements 85 which are similar to the cutting elements 18 on the face of bit 110.

Notice that the gauge cutters 85 are shown in hidden lines and are artificially rotated into the positions shown so as to illustrate their cutting profile. The secondary gauge cutters 85 are positioned and arranged to produce a borehole large enough in diameter for the entire assembly to pass upward therethrough even when the wedges 29 are fully extended, as shown in FIG. 1. Thus, the drill bit 110 and the primary gauge cutters thereof forms a pilot hole which is intended to be enlarged by the secondary gauge cutters 85 to the final desired diameter.

In order to further prevent packing of detritus material behind or under the wedges 29, vent holes 80 are formed to extend from the deeper end of each pocket 3 into each corresponding slot 27. As shown, two such vents 80 may be employed for each pocket 3.

In testing, it has been learned that forces generated by cutters 18 in the bit face, combined with forces generated by gauge cutters 85, can tend to cause the axis of the assembly to wobble relative to the axis of the borehole being drilled. Such axis wobble can cause damage to the gauge cutters 85 or to the bit face cutters 18. Therefore, as seen in FIG. 1, upper fixed stabilizing surfaces 12, such as gauge pads, are formed on body 1 or provided on a separate body member attached to the stabilizing system. As an example, the fixed stabilizing surfaces 12 could be formed as part of the body member 1, or could be provided by means of a suitable additional body member having fixed stabilizing surfaces thereon, which is coupled to the main body 1. The fixed stabilizing surfaces 12 are preferably provided in corresponding relationship to each pocket 3, and in positions axially behind gauge cutters 85 and radial bores 4, so as to be located at a predetermined axial distance behind wedges 29. In an example, the fixed stabilizing surfaces are positioned such that they are spaced from the corresponding moveable stabilizing members an axial length of not more than three times, and preferably not more than twice the gauge diameter of assembly. The fixed stabilizing surfaces 12 may also be provided with wear resistant surfaces 14, which can be integral to or can be installed in the surface of each pad 12 to provide wear resistance. Surfaces 14 may be solid tungsten carbide, or may be impregnated or coated with diamond to achieve maximum wear resistance; or, the pads 12 may be made wear resistant by some other expedient method. The fixed stabilizing surfaces in conjunction with the moveable stabilizing members provide distinct advantages in operation to avoid detrimental wobble and vibration at the drill bit tip.

The pads 12, with surfaces 14 provided or installed thereon, are sized and positioned to very nearly coincide with the borehole diameter cut by gauge cutters 85 so that only minimal clearance between the surfaces 14 and the borehole wall is allowed. Notice that the axial distance between wedges 29 and surfaces 14 is relatively short, and configured to prevent axis wobble of the assembly during drilling operation. The gauge pads 12 are effectively integral to the body 1. Of course, pads 12 could be made as part of a short profile body, commonly called a "sub", which could be weldable or otherwise attachable to main body 1 so as to be effectively integral thereto. Nevertheless, as shown in FIG. 1, pads 12 and main body 1 are a single continuous piece in the preferred embodiment.

Figure 16:
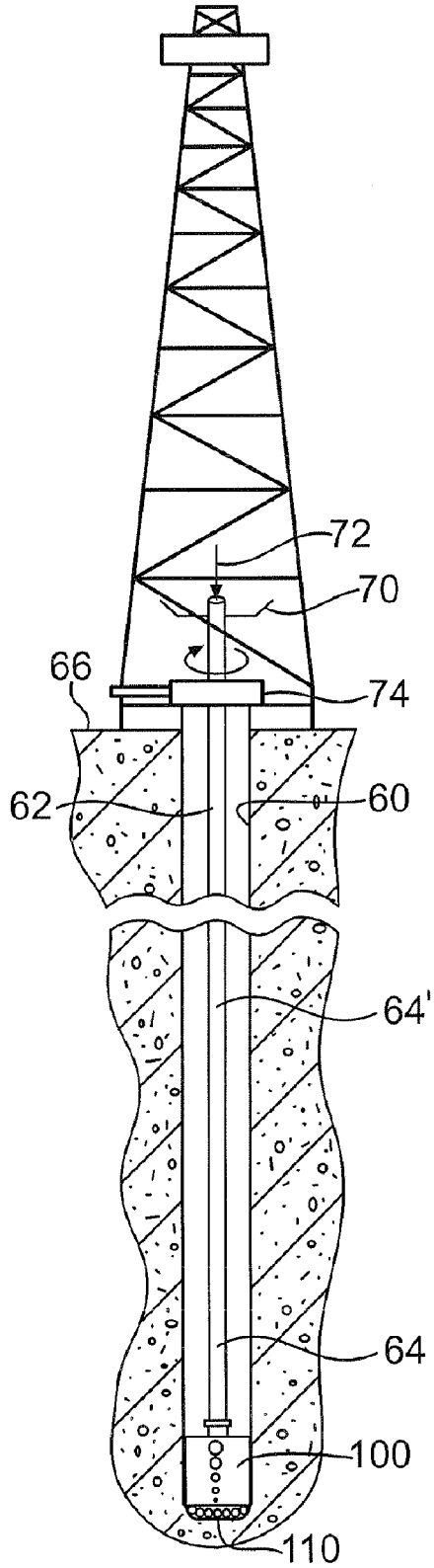
FIG. 16 is a schematic, part sectional view of a drilling operation with the present invention included therewith.

As seen in FIG. 16, a borehole 60 has a drill string 62 and a drill collar 64 therein; with the stabilizer 100 attached to the lower end thereof. A drill bit 110 is integrally attached to the lower end of the stabilizer 100. A drilling rig 70 manipulates the drill string 62. The drill string 62, drill collar 64, together with the stabilizer 100 and drill bit 110 attached, are inserted in a bore hole 60 and rotated in the conventional manner during a drilling operation. In operation, drilling fluid flows at 72 into the drill string 62, through the drill string 62, through the throat 15 of the present stabilizer 100, out of the drill bit 110, back up the bore hole annulus outside the drill string 62 and returned through a blowout preventer 74 in the usual manner. A shown in FIGS. 1, 2 and 3, flow slots 27 permit passage of the drilling fluid and, thereby, removal of drilled cuttings from the borehole.

In the above mode of operation, the wedges 29 will run in a pilot hole formed by drill bit 110 and the primary gauge cutters thereof, while the secondary gauge cutters 85 enlarge the bore hole to the desired final diameter.

In a usual operation, drilling fluid flowing through the present stabilizer 100 is at a relatively elevated pressure within throat 15, because of the usual pressure drop measured across the nozzles 25 of the drill bit 110. However, neither the fluid pressure in throat 15 nor the fluid pressure outside of stabilizer 100 will have any effect on the plungers 32. Due only to the thrust of the springs 34, the plungers 32 will thrust downward. The wedges 29 will thus be caused to move downward and outward along the slide surface 45 until the outer face of the wedges 29 abuts the wall of the pilot hole. The wedges 29 thus are held in contact with the wall of the pilot hole so long as sufficient spring tension is maintained. Also, as the outer surface of wedges 29, or the borehole wall, slowly wear due to friction against the wall of the pilot hole; the thrust of springs 34 will continually force plungers 32 and wedges 29 downward and outward to maintain the outer face of wedges 29 in constant rotating abutment with the stationary wall of the pilot hole.

The angle of the slide surfaces 44 and 45, with respect to the axis of main body 1, is of a selected value so that inward radial force exerted on the outer face of each wedge 29 produces sufficient friction between the mated slide surfaces 44 and 45 to overcome the resultant upward sliding vector force on the wedges 29, so that the wedges 29 cannot be made to retract by radial force during drilling operation. This is called "radial blocking action" which prevents radial movement of the central axis of stabilizer 100 and bit 110. The relative angle and arrangement of the slide surfaces 44 and 45 is such to block any radial inward movement of the wedges 29 at any extended position thereof when an inward radial force is exerted on the wedges 29. This is so even if such inward radial force is of a magnitude that would overcome the thrust of springs 34 in the absence of the frictional interaction of the slide surfaces 44 and 45.

The frictional interaction between surfaces 44 and 45 depends, of course, on the prevailing coefficient of friction. It has been learned that, due to the relatively large area of surface 44 on each wedge 29, as described in my prior U.S. Pat. No. 4,842,083, the coefficient of friction is sometimes reduced by conditions of the drilling fluid or other materials present during operation. Since the coefficient of friction tends to increase with the amount of contact pressure per square inch, a shallow but relatively wide relief groove 47, as shown in FIGS. 5 and 15, is formed longitudinally through the middle of slide surface 44 on each wedge 29 to reduce the effective area of each surface 44, by one half or more, and thereby increase the contact pressure per square inch between slide surfaces 44 and 45; and thus increase the coefficient of friction and frictional interaction between the slide surfaces 44 and 45. This reduces the amount of spring thrust required in order to affect the "blocking action" previously described; and also reduces the outward force and frictional drag between the outer surface of wedges 29 and the wall of the pilot hole. In addition, the longitudinal groove 47 provides a flow path for drilling fluid traveling back up the borehole annulus to flow under and behind each wedge 29 and thereby aid in removing detritus material from each pocket 3.

As shown in FIG. 2 and in FIGS. 6 through 14, the face of bit 110 has wear ridges 39 integrally formed thereon immediately trailing and corresponding to the pattern of cutting elements 18. The cutters 18 are deeply installed, and the ridges 39 are so formed, that the tips of cutters 18 initially do not extend beyond the surface profile of the ridges 39, before any wear occurs on the ridges 39. Notice that the ridges 39 of the present invention are similar to the fluid flow isolating ridge 39 of my prior U.S. Pat. No. 4,856,601, however, the ridges 39 of the present invention are much wider and stronger, so as to be able to actually support the weight applied to the bit 110 during typical drilling operation, without wearing too fast. For example, the ridges 39 of the present invention will normally be formed of high grade, hardened steel so as to be at least one-half inch wide, or more, and so as to be quite resistant to wear when rotated against the bottom of a bore hole; and wear resistant materials, such as tungsten carbide, may be applied to the ridges 39 to further increase wear resistance. This provides needed stabilization of bit 110 during the start of drilling a borehole.

For instance, when starting to drill a bore hole, either at the surface or at the bottom of a preliminary, full gauge hole drilled with a conventional drill bit, where no pilot hole exists, the wedges 29 cannot engage the wall of the full gauge hole and cannot provide any stabilization, initially. In such an instance, if the cutters 18 are allowed to fully engage, or cut into the bottom of the bore hole, the cutting forces will cause chatter or other vibrations that will damage the cutters 18, especially when the rock or other material being drilled is relatively hard.

Hence, in the ridge and cutter arrangement of the present invention, the strong ridges 39 support the normal weight-on-bit and prevent the cutters 18 from engaging until the ridges 39 wear to expose them. As rotation begins with weight-on-bit applied, the ridges 39 will normally abrade the borehole bottom sufficiently to form a matching profile pattern thereon. The ridges 39, being held against the matching profile of the borehole bottom by the weight-on-bit, will maintain stability of the bit axis. As rotation continues, the ridges 39 will slowly wear and allow the cutters 18 to begin to engage the borehole bottom, which will proportionately increase the drilling and penetration. Notice that, as the lower nose end of each wedge 29 contacts the rim of the pilot hole formed by the bit 110, the wedges 29 and the respective plungers 32 will be easily pushed upward and inward as the main body 1 and bit 110 continue to rotate, drill and descend while making hole. As drilling continues, a pilot hole will be formed by the bit 110, which will facilitate full engagement and stabilizing action of the wedges 29 against the wall of the pilot hole.

The ridges 39 are formed and arranged so that, before the wedges 29 are fully engaged and activated, the ridges 39 continue to bear most of the weight-on-bit. After the wedges 29 are fully engaged and activated, after about two feet of hole is drilled, the ridges 39 continue to wear, usually for two hours or longer, until the ridges 39 no longer bear any of the weight-on-bit; and practically all the weight-on-bit is then borne by the cutters 18. Thus, the ridges 39 provide temporary stabilization; at least until the wedges 29 are able to fully engage the pilot hole formed by the bit 110.

Since the ridges 39 are made of tough steel, which is harder than the materials typical casing plugs are made of, a drill bit and stabilizer assembly made according to the present invention can be used to effectively drill out casing plugs, without experiencing damage to the cutters 18. This is a distinct benefit, because conventional PDC bits often experience damaged cutters when drilling out casing plugs at the start of drilling oil or gas wells. Of course, hard materials, such as tungsten carbide, may be applied to the ridges 39 so as to predetermine their wear rate or abrasive characteristics.

It should be made clear that the ridges 39 of the present invention are arranged and intended so as to wear sufficiently, in due course, so that, after drilling has progressed sufficiently, the ridges 39 no longer bear any of the weight-on-bit nor any longer retard the cutting and penetrating action of the cutters 18.

During ongoing drilling operation, axis wobble of the assembly is prevented by virtue of the axial spacing between the wedges 29 and the gauge surfaces 14 and by the limited, or non-existent, clearance between the surfaces 14 and the bore hole wall. Also, in the event that detritus material accumulates in pockets 3 behind the wedges 29, the detritus material can be forced out of the pockets 3 through vents 80 and into slots 27 upon upward movement of wedges 29.

Also, even under extremely high down hole static pressure, the hydraulic force on plungers 32 will be equalized by the action of pistons 5 freely moving in bores.

Now, it can be seen from the foregoing that the present invention provides improved means for radial stabilization of a drill bit; such that whirl, chatter and other forms of radial vibration are prevented under a wide range of drilling conditions; and such that the drilling, penetrating and endurance capabilities of a PDC drill bit is maximized.

What is claimed is:

1. A drill bit for forming a bore hole wherein the drill bit is attached to a rotary drill string having an axial passageway through which drilling fluid flows to the bit face, the drill bit comprising:

a bit face comprising a plurality of wear ridges and a plurality of cutting elements;

a periphery of the bit face comprising a plurality of wear ridges and a plurality of cutting elements wherein the plurality of wear ridges on the bit face extend outwardly from the bit face to a greater degree than the plurality of cutting elements, wherein the plurality of wear ridges on the periphery of the bit face extend outwardly from the periphery of the bit face to a greater degree than the plurality of cutting elements.

2. The drill bit according to claim 1, wherein the plurality of wear ridges are formed of a wear resistant material.

3. The drill bit according to claim 1, wherein the plurality of wear ridges are integrally formed on the bit face.

4. The drill bit according to claim 1, wherein the plurality of wear ridges are positioned in trailing relationship to the plurality of cutting elements.

5. The drill bit according to claim 1, wherein the plurality of wear ridges have a width of at least one half inch.

6. The drill bit according to claim 1, wherein the plurality of wear ridges are constructed to cause abrasion of a bore hole bottom in a predetermined pattern to provide stability to the drill bit axis upon rotation in conjunction with a drill string.

7. The drill bit of claim 1 further comprising a shoulder of the bit face comprising a plurality of wear ridges and a plurality of cutting elements wherein the plurality of wear ridges on the shoulder of the bit face extend outwardly from the shoulder of the bit face to a greater degree than the plurality of cutting elements.

8. The drill bit of claim 1, wherein the wear ridges are configured in a spiral shape.

9. The drill bit of claim 1 further comprising a drill bit stabilizing system comprising a body member having at least one stabilizing member associated therewith, wherein the at least one stabilizing member is moveable between an outwardly extending operating position and a retracted position, wherein the at least one stabilizing member is moveable upwardly and inwardly relative to the body member upon initial engagement with the bore hole rim, until fully engaged with the surface of the bore hole wall.

10. A method of drilling a bore hole using a drill bit rotated in conjunction with a drill string, comprising the steps of:

providing a drill bit having a plurality of wear ridges positioned on the bit face and the periphery of the bit face and a plurality of cutting elements positioned on the bit face and the periphery of the bit face, wherein the plurality of wear ridges initially extend outwardly from the bit face or the periphery of the bit face to a greater extent than the plurality of cutting elements, rotating the drill string to initiate a drilling operation or in an existing full gauge hole to form a pilot hole, wherein upon rotation of the drill bit, the plurality of wear ridges will allow rotation of the drill bit and drill string for a period of time before engagement of the plurality of cutting elements.

11. The method according to claim 10, further comprising the step of:

providing a drill bit stabilizing system comprising a body member having at least one stabilizing member associated therewith, positioned in predetermined relationship to the drill bit so as to stabilize the drill bit and drill string upon the at least one stabilizing member engaging the bore hole.

12. The method according to claim 10, wherein the plurality of wear ridges causes abrasion of the bore hole bottom in a manner to form a matching profile pattern on the bore hole bottom, wherein the plurality of wear ridges are held against the matching profile of the bore hole bottom by the weight applied on the drill bit to facilitate stabilization of the bit axis.

13. The method according to claim 11, wherein the at least one stabilizing member is moveable between an outwardly extending operating position and a retracted position, wherein the at least one stabilizing member is moveable upwardly and inwardly relative to the body member upon initial engagement with the bore hole rim, until fully engaged with the surface of the bore hole wall.

14. The method according to claim 13, wherein the at least one stabilizing member includes a blocking mechanism to stop relative movement of the at least one stabilizing member relative to the body member upon predetermined frictional engagement between the at least one stabilizing member and the body member.

* * * * *